United States Patent [19]

Ahmann

[11] 4,445,731

[45] May 1, 1984

[54] PORTABLE VOTING BOOTH

[76] Inventor: John E. Ahmann, 1400 Duhig Rd., Napa, Calif. 94558

[21] Appl. No.: 337,967

[22] Filed: Jan. 8, 1982

[51] Int. Cl.[3] ..... A47B 43/00; G07C 13/00; A47B 3/06

[52] U.S. Cl. ..... 312/223; 312/231; 312/244; 312/258; 235/50 B; 235/52; 248/188

[58] Field of Search ..... 312/258, 223, 239, 255, 312/208, 231, 244; 248/188, 188.9; 235/50 A, 50 B, 52; 403/361

[56] References Cited

U.S. PATENT DOCUMENTS

| | | | |
|---|---|---|---|
| 2,723,174 | 11/1955 | Le Roux | 248/188 |
| 3,333,766 | 8/1967 | Crossland et al. | 235/52 |
| 3,352,616 | 11/1967 | Linger | 312/231 |
| 3,389,947 | 6/1968 | Kelley et al. | 108/36 |
| 3,452,953 | 7/1969 | Bonnamy | 248/188 |
| 3,476,456 | 11/1969 | Canavan | 312/231 |
| 3,620,587 | 11/1971 | Ahmann | 312/258 |
| 3,806,219 | 4/1974 | Ahmann | 312/258 |
| 3,957,239 | 5/1976 | Slaats et al. | 248/188 |
| 4,011,821 | 3/1977 | Neal | 248/188 |
| 4,237,798 | 12/1980 | Welsch et al. | 248/188 |

FOREIGN PATENT DOCUMENTS

| | | | |
|---|---|---|---|
| 247725 | 2/1926 | United Kingdom | 248/188 |

*Primary Examiner*—Victor N. Sakran
*Attorney, Agent, or Firm*—Owen, Wickersham & Erickson

[57] ABSTRACT

A portable self-contained voting booth has improved features of compactness, lightness of weight, leg-holding stability, durability and convenience in use. Its carrying case includes interior corner members that both provide leg sockets for receiving legs from below and also serve to receive and hold down a vote recorder or board/carrier to which a vote record system may be secured. The unit is very quickly set up and produces a sturdy free-standing voting booth. The booth may also be used for paper ballot voting by simply removing the vote recorder or other voting system carrier from the booth.

10 Claims, 4 Drawing Figures

PORTABLE VOTING BOOTH

BACKGROUND OF THE INVENTION

The invention relates to a portable voting booth which folds up into a compact carrying case and which may be set up into a free-standing booth for an election. More particularly, the invention relates to such a voting booth apparatus with novel features providing improvements in compactness, durability, convenience and versatility of uses.

Portable voting booth apparatus of the general type to which this invention relates have been in use for some time. For example, see U.S. Pat. Nos. 3,333,766, 3,389,947, 3,620,587 and 3,806,219. In general, such portable voting booths have consisted of a foldable, suitcase-like carrying case with leg sockets on the underside of the lower section of the case, for receiving break-apart legs stored in the case, and stacking buttons on the upper surface of the top section of the case, for registering with leg sockets of another voting booth case immediately above, so that a number of the folded-up booth units may be stacked together.

These voting booth apparatus have been provided with side shields which are stored within the case and which pivot up to a perpendicular position to be clipped onto the opened top section of the case to form the booth enclosure. A vote recording device has been secured inside the bottom section of the case in various ways in the prior art, and an electric lamp has been provided to provide lighting for the voter.

Self contained voting booths that have been developed heretofore were either single purpose booths to house a single voting system or useable for paper ballot or other voting systems when a shelf was overlaid the voting device or the voting device was reversed, i.e. inverted to form a shelf, for paper ballot or other voting. The present invention has allowed the multiple use of a voting booth without an overlay shelf or the inverting of the voting piece. Unlike previous booths, this suitcase type booth has a thin lower section and a flat bottom inside which can be used for paper ballot voting or other voting systems which do not use vote recording devices.

Previous self-contained portable voting booth apparatus have not had the advantageous features of compactness, lightness in weight, leg-holding stability, durability and convenience of use found in the apparatus of the present invention described below.

SUMMARY OF THE INVENTION

The portable voting booth apparatus of this invention has four special corner members mounted at the interior corners of the lower section of its hinged carrying case. In each of these special corner members is a leg socket oriented downwardly to receive and grip securely a leg inserted into the socket from below, through the bottom of the lower case section. The corner members are sturdy and secured to the case in such a way that a very stable leg connection results.

Each corner member also serves to retain the rectangular vote recorder securely in place, and to enable its quick and easy removal. At the inner side of each corner member is an inwardly protruding horizontal flange positioned to receive under it an edge of the vote recorder. The corner members and flanges are spaced such that the vote recorder can be inserted obliquely under one pair of flanges, then swung down into horizontal position adjacent to and below the level of the opposite pair of flanges. The vote recorder is then moved slidably toward and under this opposite pair of flanges to retain it at all corners. Some suitable form of resilient device is provided to urge the voting board upwardly, against the four horizontal flanges, so that the voting board is tightly retained in place but can be readily removed when necessary.

The carrying case of the improved voting booth apparatus is thinner than most prior art assemblies, and may be only three inches thick as used for a multi-purpose booth, or two inches thick as a straight paper-ballot booth. This permits compact transport and better stacking for storage.

The apparatus of the invention includes side shields which are hinged preferably by metal hinges to the corner members of the carrying case. Snap-in side shield connections as in much of the prior art are avoided. Where the side shields clip onto the upper carrying case section in the assembled configuration of the booth, strong nylon clips are employed.

Leg stowage is also improved. The four two-section telescoped legs break apart into eight short sections which are retained inside the upper carrying case section by elastic bands stretched along the interior of the case. These hold the leg sections rattle-free and permit quick and easy stowage and removal.

Light cord stowage may be interposed between the legs and the light assembly for avoiding bulb damage.

The end pieces of the legs have rounded rubber sides which engage the tubular walls of the leg sockets in the corner members on the under side of the case.

The permanently mounted lamp assembly may be so situated in relationship to the corner members and side shields, that it may be nested in between the front corner members and on top of the side shields, allowing for a thinner, more compact case/booth.

These features result in a more practical, economical and conveniently used portable voting booth apparatus. These and other objects, advantages, features and characteristics of the invention will be apparent from the following description of a preferred embodiment, considered along with the accompanying drawing.

DESCRIPTION OF A PREFERRED EMBODIMENT

Figure 1:
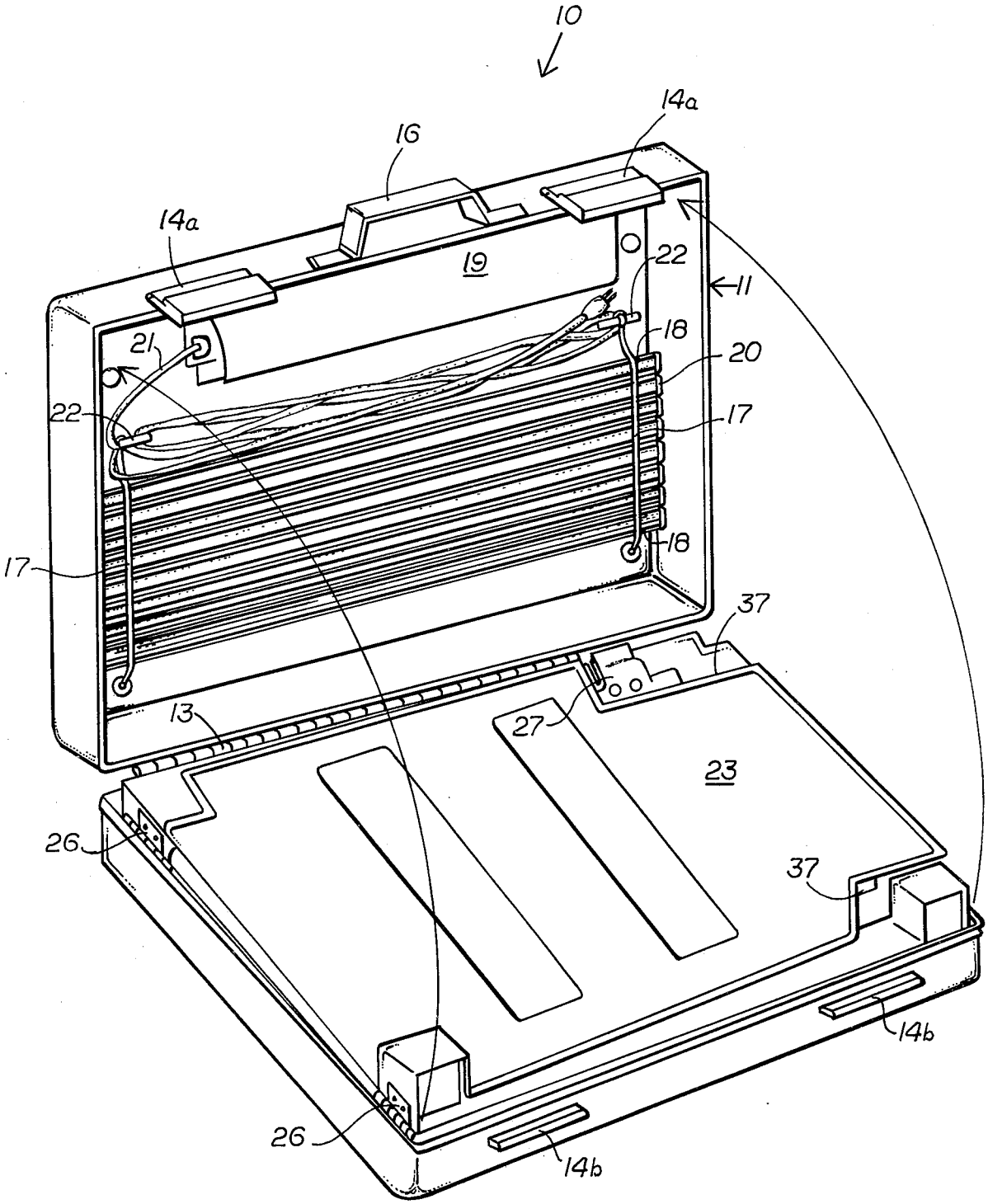
FIG. 1 is a frontal perspective view of a portable voting booth according to the invention stored in its carrying case.

In the drawings, FIG. 1 shows a portable voting booth 10 as contained in a carrying case comprising an upper section 11 and a lower section 12, hinged together preferably by a piano type hinge 13 and including latches **14*a* and 14*b* of a common type used on suitcases. A carrying handle 16 is attached to the front of the upper carrying case section 11**.

Figure 2:
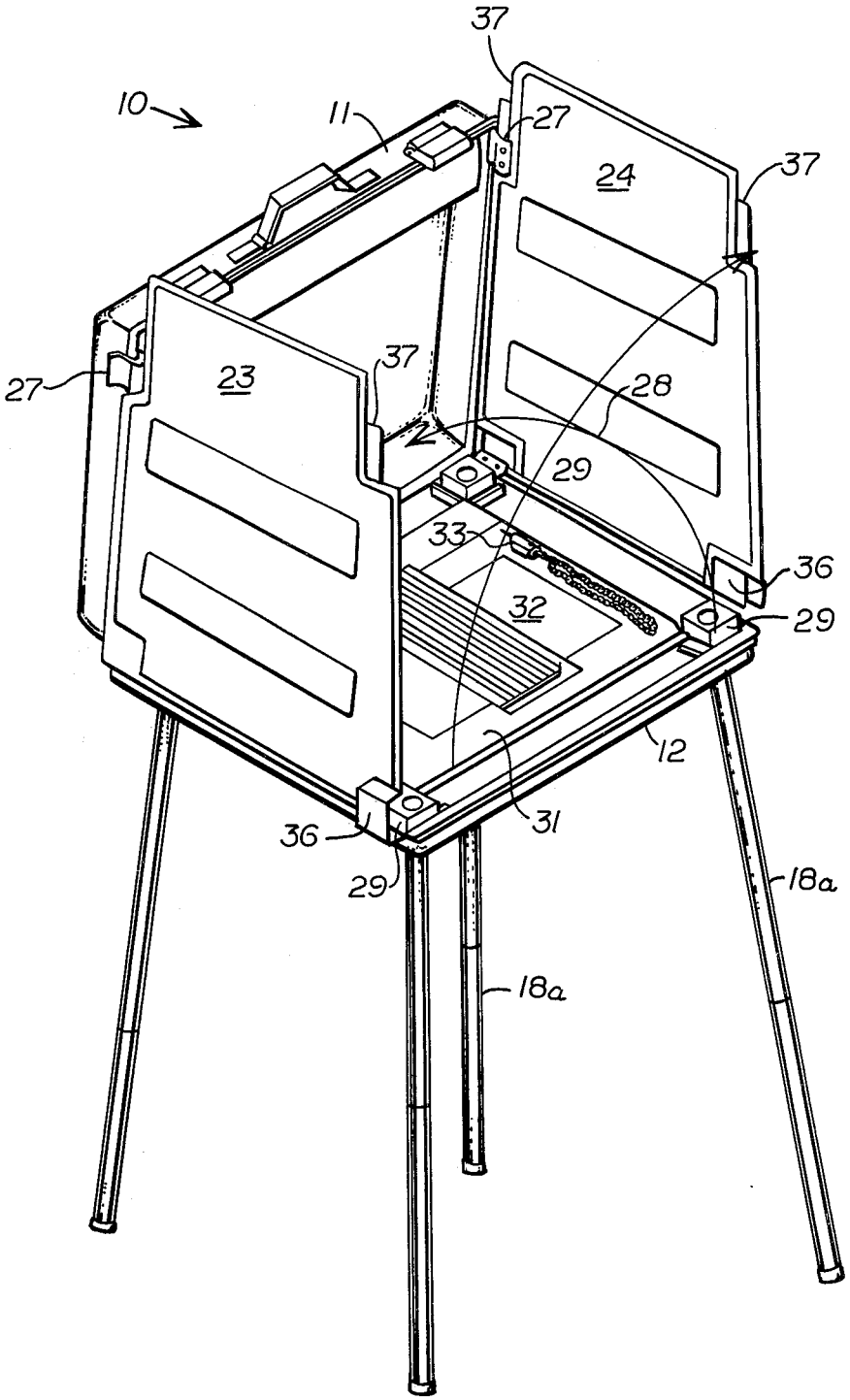
FIG. 2 is a perspective view showing the voting booth of the invention in fully assembled configuration.

As FIG. 1 illustrates, the upper case section 11 includes elastic bands 17 secured in stretched configuration in the section to receive and hold eight leg sections 18 which form four two-section legs 18*a* (FIG. 2). The elastic bands 17 provide for fast and easy storage and removal of the legs, and hold them rattle-free in the stored configuration shown. As seen in FIGS. 1 and 2, the leg sections preferably include rubber end tips 20 secured in the end of the tubular leg section and protruding outwardly with beveled or rounded edges, presenting a slightly greater diameter than the leg section itself. These are particularly on the upper ends of the upper leg sections, for engaging the leg sockets (described with reference to FIGS. 3 and 4) for improved gripping and retention. The tips 20 preferably are on the lower ends of the lower leg sections also, to serve as resilient "feet", and for interchangeability of the leg section ends, i.e. for receiving in the socket or resting on the floor.

The apparatus 10 may also include a lamp 19 at the top interior of the upper case section 11, as shown, for illuminating the booth when it is in use for voting. A cord 21 for the lamp 19 is stored in the case by clips 22, which may also secure the upper ends of the elastic bands 17 which hold the legs in the cover or upper section 11 of the case.

As in prior voting booth assemblies, a pair of side shields 23 and 24, best seen in FIG. 2, make up the voting enclosure along with the upper and lower sections 11 and 12 of the carrying case. The left side shield 23 is seen in FIG. 1, where the side shields are folded into their stored configuration, but either shield can be folded in first. The shields are secured to the lower case section 12 by sturdy hinges 26, preferably of metal. On the back upper edge of each side shield, as shown on the left side shield 23 in FIG. 1, is a clip 27 for engaging and gripping the upper case section when the booth is in its fully assembled configuration shown in FIG. 2. These clips should be strong and durable, preferably of nylon.

FIG. 1, showing the carrying case with its upper section having been opened, illustrates the first step in assembly of the booth 10.

FIG. 2 shows the booth 10 set up and ready for use, with arrows 28 indicating final steps in the assembly, the raising of the side shields 23 and 24, followed by engagement of the retaining clips 27. The leg sections 18 have been assembled to make the four legs 18*a* and inserted up into the bottom of the lower case section 12, into special corner members 29 which, as discussed below, also serve to hold a vote recorder 31 securely in place.

As shown in FIG. 2, each side shield 23, 24 preferably has raised areas 36 at front corners adjacent to the special corner members 29. Thus, the shields fit over the corner members 29 in the stored configuration (FIG. 1), without the need for a cut-out area at those corners of the shields. At the rear corners of the side shields, they may simply be spaced out from the lower case section 12 to clear the corner members, by the manner in which the hinges 26 are attached, as shown in FIG. 1. At the upper corners of the shields 23 and 24, there are cut-out areas 37 to enable those ends of the shields to fit between the corner members 29 in the case 12 (see also FIG. 1).

Figure 3:
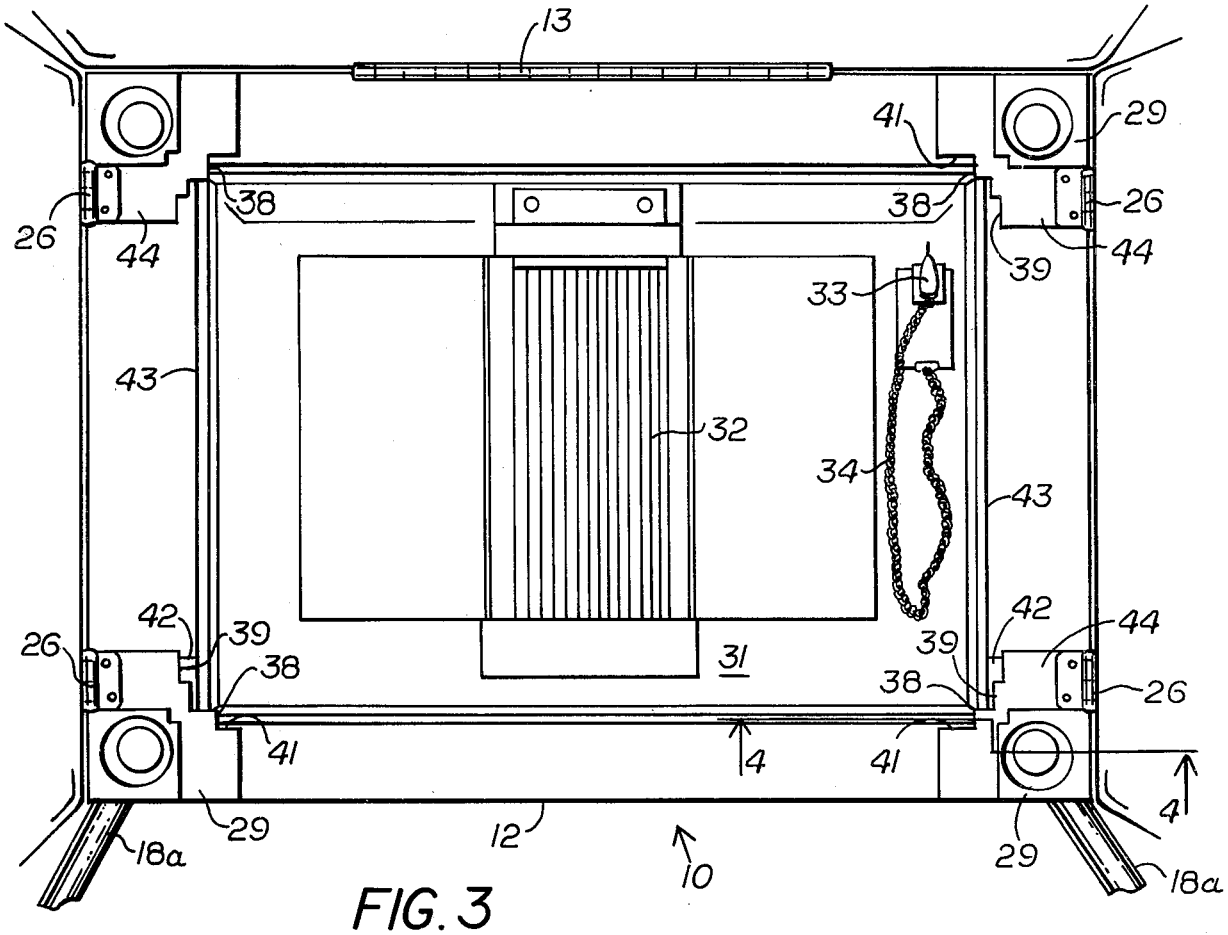
FIG. 3 is a plan view of a portion of the assembled voting booth, showing the voting board retained in the lower carrying case section.

FIG. 3 shows in greater detail the vote recorder 31 and the manner in which it is retained in the lower carrying case section 12. The special corner members 29 each include a flange 38 extending inwardly as shown, as a protruding shelf. On either side of this flange 38 are vertical abutment walls 39 and 41 which limit the position of the vote recorder 31 and guide it into place. At the corner members 29 at the front corners of the lower carrying case section 12, pieces of soft, resilient foam material 42 are included, to act as spring-type locators for the vote recorder 31. The vote recorder 31 is removable from the lower carrying case section 12 by sliding it to the left or right, against the springing action of the resilient foam 42, which brings the opposite edge 43 out from under the pair of flanges 38 which normally retain that edge 43 down. That opposite edge 43 may then be lifted out and, with the vote recorder then at an oblique angle, it may be removed by sliding it out from under the opposite pair of flanges 38. Conversely, assembly of the voting board 31 into the case simply requires first slipping either the left or right edge 43 of the vote recorder under the two flanges 38 on one side, with the vote recorder 31 at an oblique angle, then pushing the board 31 laterally against the resilient foam patch 42 on that side until the opposite edge 43 clears the two protruding flanges 38 on that side. It is then lowered into horizontal position, pushed down slightly until the lowered edge 43 is below the flanges 38, and shifted back centrally, to a position approximately equalized between the two resilient foam patches 42 at the front left and front right. The vote recorder 31 is therefore quite easily removed and replaced, in case access is needed for maintenance or repair, or in case a different type of vote recorder is desired to be installed in the voting booth apparatus 10.

Preferably the bottom inside surface of the lower carrying case section 12 is shallow and flat to facilitate a writing surface on the inside of the booth when the vote recorder 31 or other voting device is removed.

It should be understood that the manner in which the vote recorder 31 is assembled could be by forward-/backward movement rather than left/right movement as described, i.e. the structure of the corner members 29 could be such that the back edges of the vote recorder would first be slipped under flanges 38, then the front edge brought down into position.

The corner members 29 not only hold the vote recorder in place, but also receive and securely support the assembled legs 18*a*, which are inserted from below (FIGS. 2 and 3). Also, they may support the hinges 26, which, as shown in FIG. 3, may be secured directly to a horizontal portion 44 of each corner member 29. The corner members may be secured to the lower carrying case section 12 by any suitable type of gluing or fasteners, but preferably are held in by an assembly system described below in reference to FIG. 4.

Figure 4:
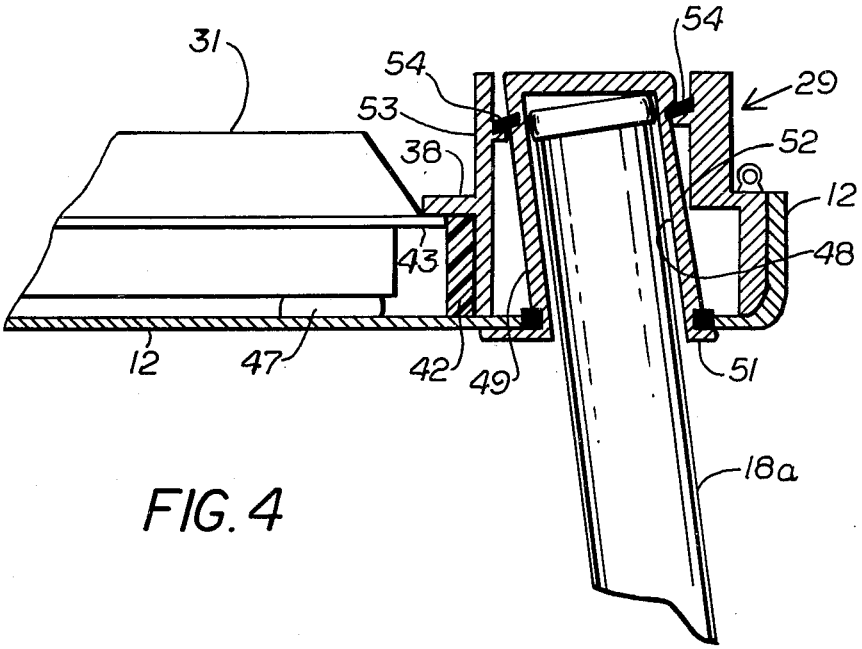
FIG. 4 is a sectional view showing in detail a portion of the voting booth.

FIG. 4 shows in sectional elevation the protruding flange 38 holding down the edge 43 of the vote recorder. The resilient foam piece 42 is shown bearing against the edge 43 of the vote recorder. As indicated, foot pads 47 of rubber or other resilient material are secured to the bottom of the voting board 31 in order to provide some resilience as the voting device or holder 31 is pushed down during assembly into the carrying case 12.

FIG. 4 also shows one of the legs 18*a* closely received in a socket 48 of the corner member 29. The corner member may be comprised of two pieces as indicated: a lower piece 49 which forms the socket 48, comprising a flange 51 engaged against the bottom of the case section 12 and an integral tubular portion 52, inserted from the bottom on assembly; and an upper piece 53, assembled from above and including the retaining flange 38. A clip or retaining ring 54 holds the two sections of the corner members from separating, as indicated. On assembly, the ring 54 is slipped over and around the component 49, into position between the components 49 and 53.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. In a portable, self-contained voting booth apparatus having a foldable carrying case having an upper section hinged to a lower section, four multiple-section take-apart legs, a pair of side shields and a vote recorder to which may be secured a punch card type vote registering device, the improvement comprising:

four corner members mounted at the front and rear interior corners of the lower section of the carrying case, each having a leg socket oriented downwardly to receive and grip a leg inserted into the socket from below, through the bottom of the lower section, each corner member also including a horizontal flange positioned to receive an edge of the vote recorder thereunder to lock the vote recorder in place, the corner members and flanges being spaced so that the vote recorder can be inserted obliquely under one pair of flanges, then swung down into position adjacent to and below the opposite pair of flanges and moved slidingly toward and under said opposite pair to retain the vote recorder down at all corners.

2. The apparatus of claim 1, further including elastically deformable foam positioned on at least two of the corner members, adjacent to the horizontal flanges, for urging the vote recorder toward a central position between the corner members.

3. The apparatus of claim 1, wherein the side shields are hinged to the corner member in the lower case section, with clips on the side shields for securing the side shields to the upper section when the voting booth apparatus is set up.

4. The apparatus of claim 1, including a pair of elastic bands secured inside the upper case section and positioned for receiving in sections the multiple-section legs and retaining them in place against the inside of the upper case section.

5. The apparatus of claim 1, wherein each corner member comprises two assembled pieces, a lower piece including the leg socket and an upper piece including the horizontal flange, the lower case section having an opening through which the lower piece is inserted and the lower and upper pieces engaging the lower case section between them, with clip means for holding the lower and upper pieces together and locking them into the lower case section.

6. The apparatus of claim 1, wherein said apparatus includes resilient means positioned between the lower case section and the vote recorder for urging the vote recorder upwardly, against the four horizontal flanges, to retain the vote recorder securely in place.

7. A portable voting booth as described in claim 1 or 6, wherein the upper ends of the legs have rubber end tips with rounded protruding edges which engage the leg socket for improved gripping and leg retention in the leg socket.

8. A portable voting booth as described in claim 1 or 6, wherein the bottom of the lower case section is shallow and flat to facilitate a writing surface on the inside of the booth when the vote recorder or other voting device is removed.

9. The apparatus of claim 1, including a lamp assembly secured to the inside of the upper case section, positioned to lie between the two corner members at the front of the lower case section when the carrying case is in a closed position with the upper and lower sections together.

10. The apparatus of claim 4, including a lamp assembly secured to the inside of the upper case section toward its front, said elastic bands being positioned to retain the leg sections at a location rearward of the lamp assembly in the upper case section, and including a lamp cord connected to the lamp assembly, with lamp cord stowage means in the upper case section for removably retaining the lamp cord between the lamp assembly and the leg sections, for helping protect the lamp assembly from the leg sections.

* * * * *